United States Patent [19]

Ekins

[11] Patent Number: 4,781,651

[45] Date of Patent: Nov. 1, 1988

[54] ATHLETIC SUPPORT BRASSIERE

[76] Inventor: Christina L. Ekins, 21227 De La Guerra St., Woodland Hills, Calif. 91364

[21] Appl. No.: 73,524

[22] Filed: Jul. 15, 1987

[51] Int. Cl.[4] ..... A41C 3/00

[52] U.S. Cl. ..... 450/79; 450/25; 450/85

[58] Field of Search ..... 450/5, 18, 25 X, 73, 450/75, 77, 79, 85 X, 86

[56] References Cited

U.S. PATENT DOCUMENTS 2,468,623 4/1949 Gluckin ..... 450/60

4,174,717 11/1979 Schreiber et al. ..... 450/86

4,254,777 3/1981 Johnston ..... 450/41

*Primary Examiner*—Werner H. Schroeder

*Assistant Examiner*—Jeanette E. Chapman

*Attorney, Agent, or Firm*—Donald D. Mon

[57] ABSTRACT

A support brassiere for the female breasts for use in energetic activities such as running, jogging, aerobics and track events. A pair of flexible cups are supported from above by shoulder straps, and beneath by an encircling band. An inelastic flexible stabilizer strip is attached to the encircling band and is adjustably brought to bear against it and the rib cage immediately below the breasts. The support from below prevents breast sag and thereby reduces the bouncing of the breasts.

8 Claims, 1 Drawing Sheet

FIG. 1
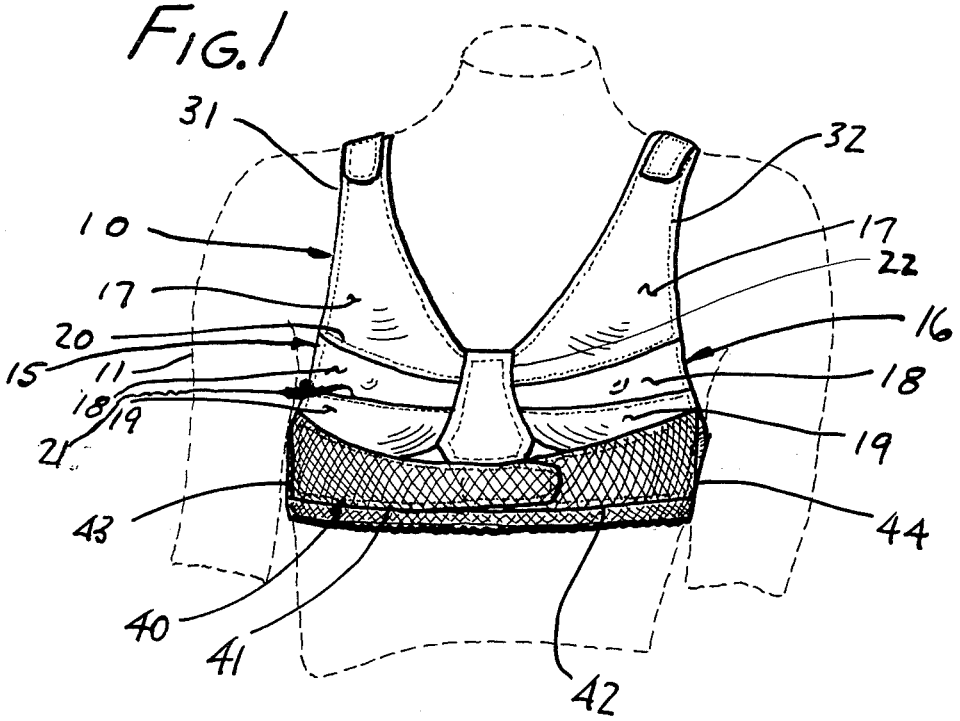
FIG. 3
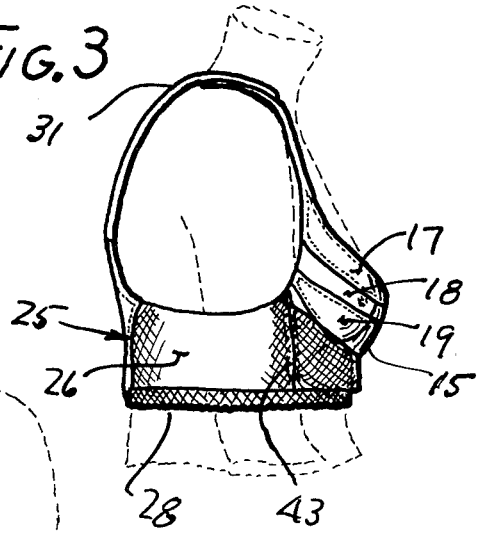
FIG. 2
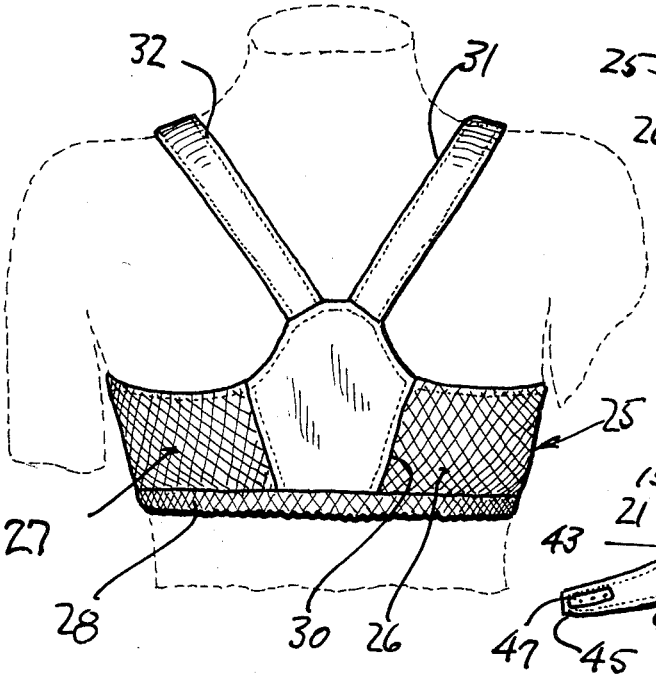
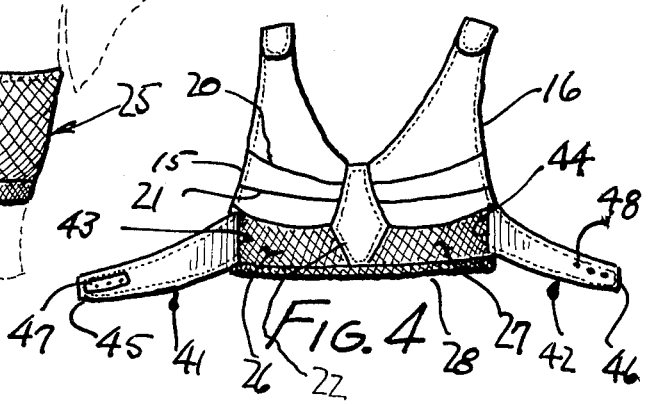
FIG. 4

ATHLETIC SUPPORT BRASSIERE

FIELD OF THE INVENTION

This invention relates to brassieres that are primarily intended to support the female breasts during athletic activities such as running, jogging, aerobic and track events.

BACKGROUND OF THE INVENTION

Unless the female breasts are suitably restrained, vigorous body movements involved in athletic activities such as running, jogging, aerobics, and track events cause the breasts to bounce and bob relative to the torso. It is known that such breast movement will, over a period of time, result in permanent breast sag. This is especially the situation, but not exclusively so, for larger or already pendulous breasts. A woman looking to a long life should and does care about this problem, because there is only disadvantage in what ultimately occurs to the breasts.

However, not all problems are as long range in effect. For example, the activities are usually engaged in for pleasure, for profit, and often for competition with others. Concentration on the activity is essential when engaged in competition. The distraction caused by uncomfortable bobbing of the breasts and of attendant discomfort is deleterious to serious efforts. If the activity is engaged in for pleasure, the pleasure is lessened by the distraction and discomfort.

In addition to these physical reactions within the participant there is a social distraction. A woman running along a street or sidewalk with bouncing breasts does attract attention, called-out comments, and honking horns. For many women, this lessens the pleasure in the activity.

The desirability of stabilizing the breasts relative to the torso has long been recognized, for the above reasons among others. Brassieres do exist for the purpose of stabilizing the breasts. Even brassieres worn primarily for routine activities have support in mind. However, the tendency in the prior art is to clamp onto the breasts tightly in a band-like manner, to prevent the breasts from bobbing upwardly. This in itself constitutes a serious restriction on the athletic woman—so much so that many prefer to accept the disadvantages of unbound or of loosely bound breasts.

It is an object of this invention to provide an athletic support brassiere which stabilizes the breasts against excessive bounce and sway, without substantially interferring with the freedom of body movements and easy breathing.

BRIEF DESCRIPTION OF THE INVENTION

A support brassiere according to this invention reduces breast bounce by substantially preventing their downward movement. The breasts are supported by flexible inelastic material shaped as cups, just above and encircling a support band that encircles the torso, a stabilizer strip attached to the encircling band immediately beneath the cups to support the breasts. It is releasable to facilitate putting on the brassiere.

Flexible inelastic shoulder straps support the cups further to prevent downward movement. The straps and the band are attached at the back of the brassiere.

The invention will be fully understood from the following detailed description and the accompanying drawings, in which:

BRIEF DESCRIPTION OF THE DRAWINGS

FIG. 1 is a front view showing the brassiere in place;

FIG. 2 is a rear view of FIG. 1;

FIG. 3 is a right hand side view of FIG. 1 with the arm in phantom line; and FIG. 4 is a fragmentary view similar to FIG. 1, with the band disengaged for purposes of illustration.

DETAILED DESCRIPTION OF THE INVENTION

FIG. 1 shows the presently-preferred embodiment of a brassiere 10 according to the invention on a woman 11 who is schematically shown in phantom line. The purpose is to stabilize the breasts against upward bounce. Essentially this is accomplished by preventing downward sag of the breasts, but in a comfortable and compliant way.

The brassiere includes a pair of cups 15, 16, each of which is shaped to conformably receive one of her breasts. Conveniently each cup is made of three pieces 17, 18, 19 of flexible, relatively inelastic, non-stretchable material. The center piece is disposed so as to overlay the nipple. Thus, seams 20, 21 are on each side of the nipple, and do not cause an uncomfortable rubbing or abrasion.

A cup joinder 22 is stitched to the cups. It also is formed of flexible non-stretching material.

An encircling band 25 includes stretchable mesh portions 26, 27, and an elastic band 28 at the bottom which extends almost all the way around the brassiere.

A back joinder 30 completes the encircling band 25 at the rear center. Joinder 30 is made of non-stretchable flexible material, to which shoulder straps 31, 32 are stitched. These straps are not stretchable. They are detachably attached to the respective cups near the top of the cups. Attachment means 33 such as snaps or Velcro serve to join the straps to the cups, preferably enabling an adjustment of their length.

The wearer puts on the brassiere with the straps released. The encircling band is sufficiently yielding to enable the garment to pass over the shoulders and be adjusted in place. The length of the straps may be adjusted or permanently fixed, as desired. Usually it will be best practice to make the lengths adjustable by appropriate provisions of the attachment means—a sufficient length of Velcro, or a plurality of snaps, for example.

When correctly fitted, the cups will return to the wearer's skin at the rib cage just below the breasts, and the elastic features of the encircling band will encourage this. However, this is not sufficient for support of the breasts as intended by this invention.

For this purpose there is provided a stabilizer strip 40 comprised of two strip portions 41, 42 of flexible unstretchable material. These strips are anchored to the encircling band at seams 43, 44 located near where the woman's side and front surfaces of the rib cage converge. This is about at the outer ends of the respective cups. When the brassiere is worn, seams 43, 44 will be about vertical when the woman stands upright.

The free ends 45, 46 of the straps are provided with joinder means 47, 48, preferably snaps or Velcro, with plural snaps or sufficient length of Velcro that the tightness of the stabilizer strip can be adjusted by shortening or lengthening the fastened length of the strip.

The strip portions taper somewhat toward their free ends so as to fit closely to the curvature of the breasts where they return to the face of the rib cage. The stabilizer strip provides a firm reinforcing portion of the encircling band directly beneath the breasts. There is some elasticity from the remainder of the encircling band, but this elasticity occurs elsewhere than beneath the breasts, and permits easy breathing, but without reducing the support given to the breasts.

For smaller and medium range size breasts, seams 43, and 44 need not be rigid, because a well-stitched seam will suitably resist deformation under their lesser loads. For larger breasts, it is useful to insert a stiffly flexible stay (not shown) in this seam to keep the seam in the illustrated alignment.

The cups are preferably made of two sets each of three pieces stitched together. Instead, one set of these pieces could be backed up by a single piece of material, still keeping the seams where they are shown. This would eliminate a few manufacturing steps.

Also, an inner stabilizer sheet of innerfacing material can, if desired be included in the cups between the two layers forming them. Innerfacing material will add considerable resistance to deformation of the cups, but is optional.

The brassiere is put on with the stabilizer strip released. It is adjusted as desired, and then the stabilizer strip is fastened tightly against the rib cage. The brassiere is now ready for use.

When the woman's foot hits the ground, the tendency is for the breast to keep going down, and then rebound upwardly. However, it can rebound upwardly by a substantial amount only if it can first sag downwardly. This brassiere, by the stabilize strip and the non-stretching cups, prevents substantial sag. While the contour of the breasts may change somewhat due to the flexibility of the cups and changes in alignment of the shoulders, this is not the kind of movement that leads to discomfort, distraction, or ultimate permanent sagging of the breasts.

As the woman lifts upwardly and starts a return-to-ground movement, the continuing upward movement of the breasts will be minimized by the absence of prior sag, and also by at least some confinement by the cups and shoulder straps. It will be observed that the encircling band is stitched to the cups almost as high as the nipples, so that the side support thereby given minimizes sway and also serves to hold in the breasts against outward and upward movement, still leaving sufficient elasticity for comfortable breathing.

This invention thereby provides a simple, comfortable and effective garment to control undesired movement of the breasts during energetic athletic activities.

This invention is not to be limited by the embodiment shown in the drawings and described in the description, which is given by way of example and not of limitation, but only in accordance with the scope of the appended claims.

I claim:

1. A support brassiere for athletic activities comprising:

a pair of flexible breast-receiving cups, made of non-stretchable material inelastically joined to each other at the front center of the brassiere;

an encircling band stretched to the bottom margins of said cups, providing sufficient elasticity to enable the brassiere to pass over the shoulders and fit over the breasts, and enabling free breathing of the wearer;

a stabilizer strip comprising a pair of stabilizer strip parts each stitched to said encircling band at locations spaced from said front center, and having free ends adapted to be fastened to one another, said stabilizer strip being flexible, inelastic and non-stretchable, so disposed and arranged as to fit flat against the rib cage immediately beneath the breasts; and a pair of shoulder straps each attached to the back of said encircling band and to a respective cup to support said cups from above.

2. A brassiere according to claim 1 in which said shoulder straps are formed in two parts, adapted to be joined and separable to facilitate putting on the brassiere.

3. A brassiere according to claim 1 in which each said cup is made of three pieces of said material, with the center one of them overlying the nipple.

4. A brassiere according to claim 1 in which said cups are joined by an insert of flexible, inelastic, non-stretchable material.

5. A brassiere according to claim 1 in which said encircling band includes an insert of flexible, inelastic, non-stretchable material at the back center of the encircling band to which the rearward ends of the shoulder straps are attached.

6. A brassiere according to claim 1 in which said encircling band includes a substantial length of elastic material adjacent to its lower edge.

7. A brassiere according to claim 6 in which said elastic material completely encircles the brassiere.

8. A brassiere according to claim 1 in which a stiffly flexible strap is included in the seams attaching the stabilizer strip parts to the encircling band.

* * * * *